US008245550B2

(12) United States Patent
Willits et al.

(10) Patent No.: US 8,245,550 B2
(45) Date of Patent: Aug. 21, 2012

(54) APPARATUS FOR PROVIDING A ROLLING ACTION OF A CURVED TOOL ALONG A FLAT STATIONARY SUBSTRATE

(76) Inventors: Samuel P Willits, Barrington, IL (US); Steven F Willits, Barrington, IL (US)

( * ) Notice: Subject to any disclaimer, the term of this patent is extended or adjusted under 35 U.S.C. 154(b) by 0 days.

(21) Appl. No.: 12/930,489

(22) Filed: Jan. 7, 2011

(65) Prior Publication Data

US 2012/0174648 A1 Jul. 12, 2012

(51) Int. Cl.
*B21B 1/00* (2006.01)

(52) U.S. Cl. ..... 72/67; 72/74; 72/214; 72/406; 101/5; 101/22

(58) Field of Classification Search ..... 72/67, 112, 72/214, 220, 406, 452.5, 74; 101/5, 6, 8, 101/22, 23, 25
See application file for complete search history.

(56) References Cited

U.S. PATENT DOCUMENTS 2,254,289 A * 9/1941 Jensen ..... 72/124
2,726,562 A * 12/1955 Haase ..... 72/205
3,166,008 A * 1/1965 Lewandoski ..... 101/6
3,695,079 A * 10/1972 Muller ..... 72/208
3,792,602 A * 2/1974 Fukuda ..... 72/220
3,995,468 A * 12/1976 Grinshpun et al. ..... 72/214
5,007,281 A * 4/1991 Aoshima et al. ..... 72/406

FOREIGN PATENT DOCUMENTS

JP 61-180635 * 8/1986
JP 61-193737 * 8/1986

* cited by examiner

*Primary Examiner* — Edward Tolan
(74) *Attorney, Agent, or Firm* — Thomas R. Vigil

(57) ABSTRACT

The apparatus comprises a crank arm in a crank-arm press with a curved tool at the end of the crank arm being constrained to move so the curved tool makes rolling contact across a flat, stationary substrate. The crankshaft rotates about an axis, the crank arm is rotatably mounted at one end to the crankshaft, a curved tool is mounted at the other end of the crank arm, a line on the surface of the curved tool and parallel to the crankshaft axis of rotation is constrained to move perpendicular to a plane while the curved tool is in rolling contact with the substrate, said plane being the plane of the flat stationary substrate, the radius of curvature of the curved tool being greater than the length of the crank arm; and with the radius of the curved tool, the length of the crank arm, and the eccentric radius of rotation of the crankshaft being selected to maintain the contact line of the curved tool in the substrate plane during the rolling contact.

5 Claims, 6 Drawing Sheets

APPARATUS FOR PROVIDING A ROLLING ACTION OF A CURVED TOOL ALONG A FLAT STATIONARY SUBSTRATE

FIELD OF THE INVENTION

The present invention relates to apparatus for eccentrically moving a curved die arcuately to provide a roiling motion in a workplace for cutting or stamping a stationary substrate.

DESCRIPTION OF THE PRIOR ART

Heretofore, curved rotary dies have acted on moving substrates and curved rolling dies operated by cams have acted on stationary substrates.

BRIEF SUMMARY OF THE INVENTION

According to the present invention there is provided an apparatus to provide a rolling motion of a curved die along a flat stationary substrate supported on a flat anvil comprising, a rotating crankshaft with an axis of rotation and an eccentric axis of rotation, a crank-arm rotatably mounted at one end on a shaft with said eccentric axis and having at the other end an extremity, at least one curved cylindrical die having a radius of curvature greater than distance between an axis coincident with a line on the curved surface of said curved cylindrical die and said eccentric axis of rotation said coincident axis parallel to said axis of rotation of said crankshaft and a mechanism to restrict said coincident axis to move in a plane parallel to a plane containing said crankshaft axis of rotation and perpendicular to said flat anvil when said curved die is in contact with said substrate

DETAILED DESCRIPTION OF THE INVENTION

Figure 1:
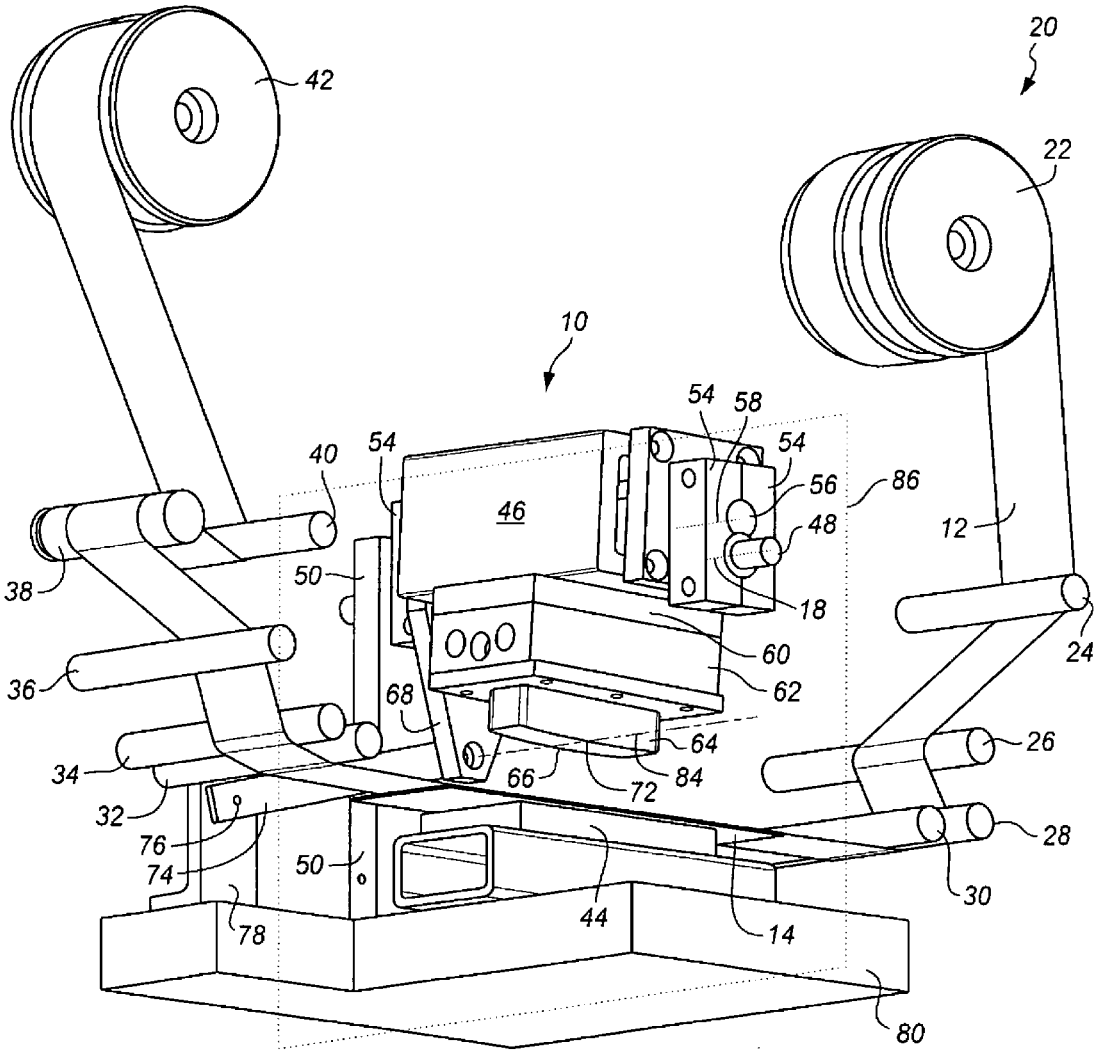
FIG. 1 is an isometric view of an apparatus constructed according to the teachings of the present invention for eccentrically moving a heated, curved die with a rolling motion over a foil film for hot stamping foil patterns onto a stationary substrate.
Figure 2:
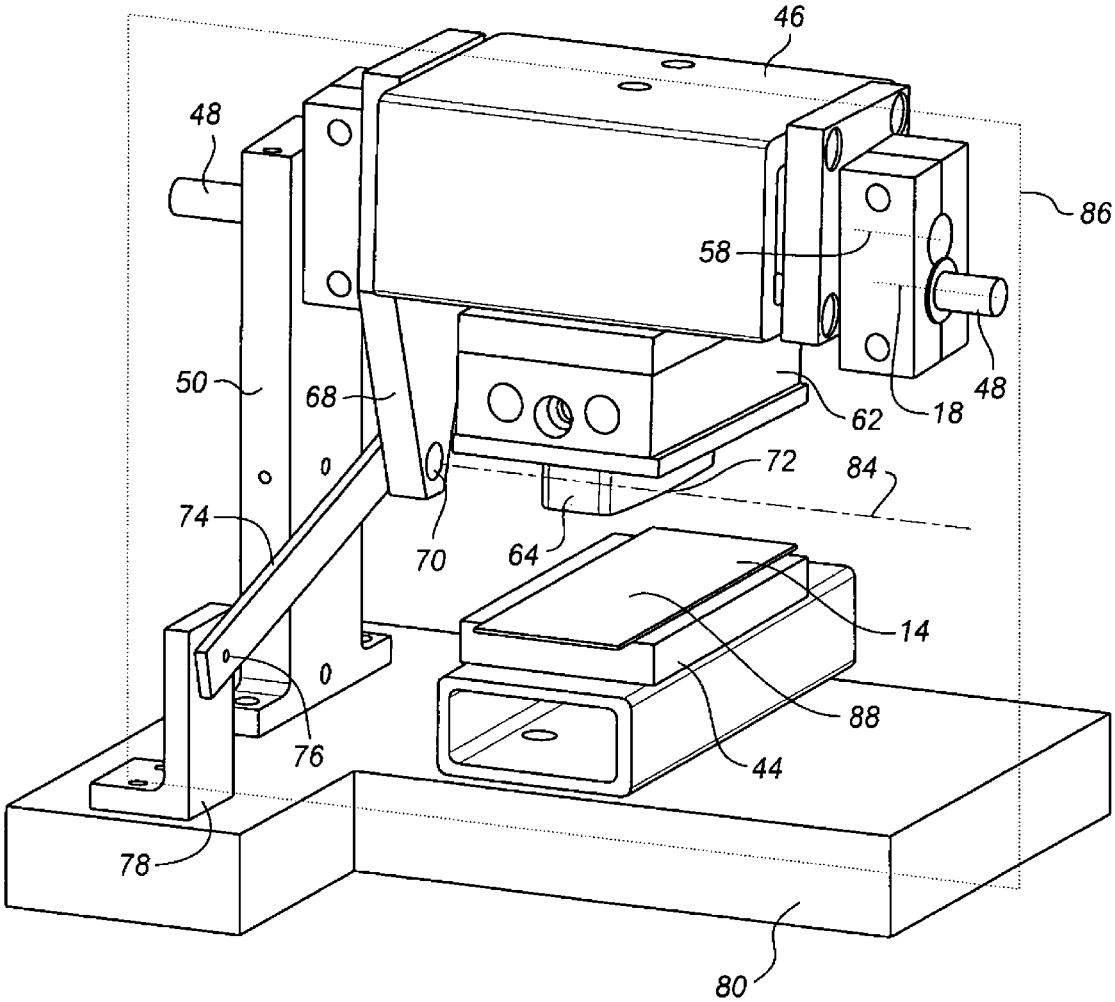
FIG. 2 is an isometric view of the apparatus shown in FIG. 1. with the film handling system removed.

Referring now to the drawings in greater detail, in FIG. 1 there is displayed a hot stamp machine for eccentrically moving a curved, heated die 64 in an arcuate motion across a film 12 to hot stamp a pattern from the film 12 onto a substrate 14. The arcuate motion is generated by eccentrically moving heated die 64 around eccentric moving axis 58. The hot stamp machine apparatus comprises a crank shaft shown here as a rotationally driven shaft 48 with its center point on an axis 18, which is journalled for rotation in rear support plate 50 and a front support plate at the opposite end of shaft 48 not shown, a second rotating shaft 56 on a second axis 58 a fixed dimension B from the axis 18 and rigidly attached to shaft 48 at both ends by the split clamps 54; a crank arm 10 comprising the carrier 46, plate 68, insulator 60, and heater plate 62, the crank arm 10 rotatably mounted to shaft 56 at one end; the die 64 with the cylindrical stamping surface 66 with radius A mounted at the other end (an extremity) of crank arm 10, and having a line 84 on cylinder surface 66 held essentially coincident with a plane 86 or a plane parallel to plane 86 by the control arm 74 while curved die 64 is in line contact with the foil 12 laying on substrate 14, control arm 74 being rotatably mounted at one end by a pin through bearing 70 in depending plate 68 which is fixed to carrier 46 and centered on axis 72, the axis 72 being coincident with line 84, and pinned at the other end for rotation about point 76 on an upright arm 78 which is mounted on a base plate 80 which also supports the upright frame member 50 and the anvil 44, the point 76 being located essentially on a plane 88 passing through line 84, perpendicular to plane 86 and parallel to substrate 14, when line 84 is at the lowest point of its stroke relative to substrate 14. Plane 86 is defined by axes 18 and 58 when rotated at 0 degrees and at 180 degrees. The action of control arm 74 could also be accomplished with a cam follower bearing at point 72 and travelling in a track parallel to plane 86. The Substrate 14 to be hot stamped is supported by the anvil 44. A foil feeding mechanism 20 includes foil unwind 22 and rewind 42 spools, and guide rods and rollers 24, 26, 28, 30, 32, 36, 38 and 40. Items 24 thru 40 may function as a simple drive, stepper or servo drive for the film.

Figure 3:
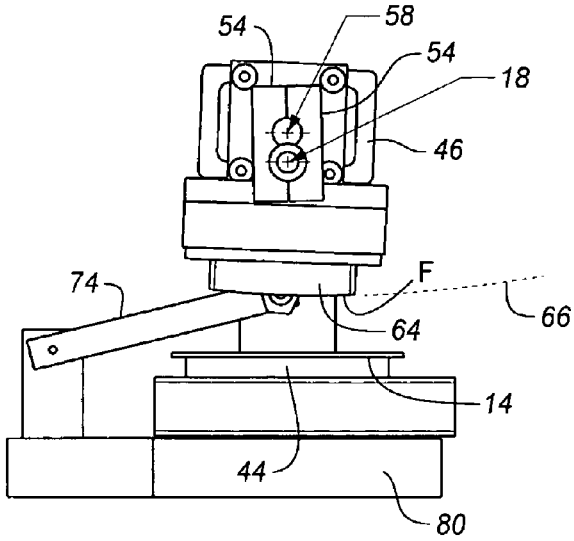
FIG. 3 is a front elevational view of the apparatus shown in FIG. 1 with the film feeding mechanism omitted and showing a die of the apparatus in a raised position.
Figure 4:
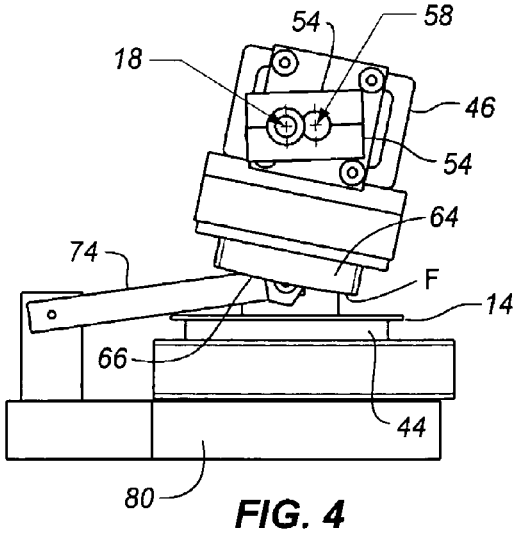
FIG. 4 is a view similar to FIG. 3 but with the die moving eccentric rotated approximately 90 degrees to move the die partially downward.
Figure 5:
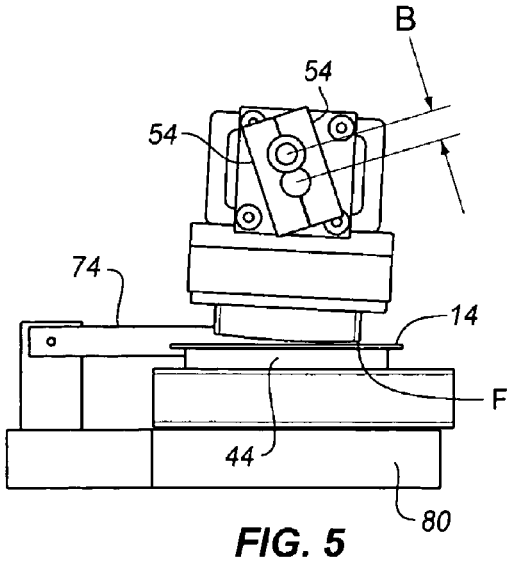
FIG. 5 is a view similar to FIG. 3 but with the die moving eccentric rotated further to move the die downwardly until a leading edge of the die contacts the substrate.
Figure 6:
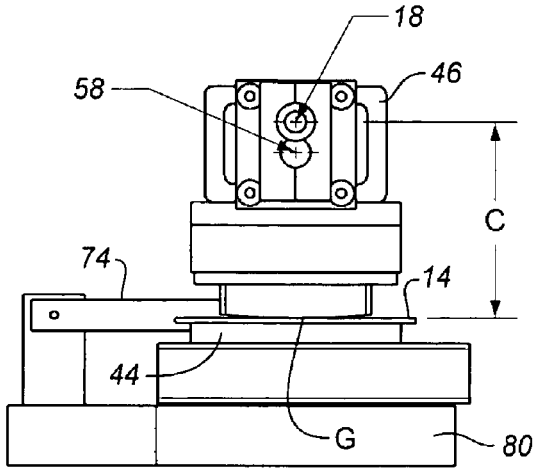
FIG. 6 is a view similar to FIG. 3 but with the die moving eccentric rotated approximately to a generally vertical position, which motion rolls the curved die such that the contact line between the curved die and flat substrate moves horizontally until the contact line is near the mid-sector of the curved die.
Figure 7:
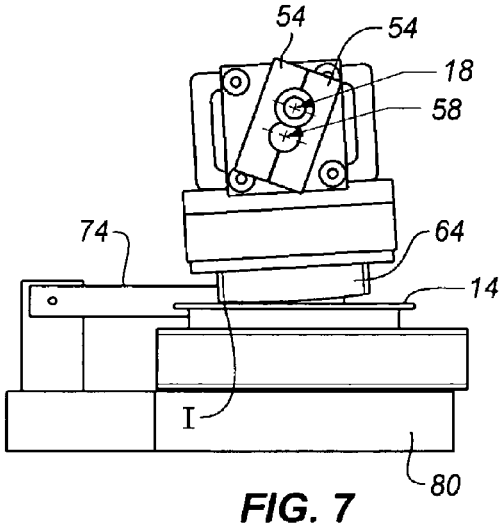
FIG. 7 is a view similar to FIG. 3 but with the die moving eccentric rotated further to continue to roll a contact line between the curved die and flat substrate horizontally until a trailing edge of the die is in contact with the substrate.
Figure 8:
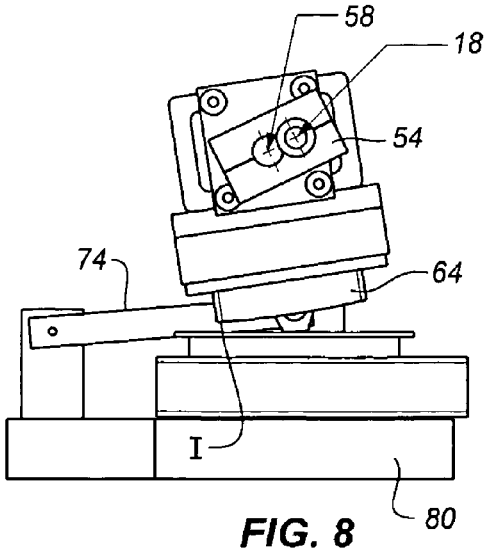
FIG. 8 is a view similar to FIG. 3 but with the die moving eccentric rotated further to move the die partially upward away from the substrate and toward its upward position shown in FIG. 3.

The substrate 14 is moved into position in the apparatus and remains stationary on a flat anvil 44 during the stamping process. The mechanism of the apparatus then produces an action as illustrated in sequential FIGS. 3 through 8. Beginning from the near top of stroke position shown in FIG. 3, shaft 48 begins to rotate shaft 56 around axis 18. Stamping die 64 motion is restricted by lever arm 74 causing a first edge F of curved die 64 to displace vertically toward substrate 14 (FIG. 4) until first edge F contacts substrate 14 (FIG. 5), then rolls across the surface of substrate 14 maintaining a contact line G of curved surface 66 of die 64 at a relatively constant elevation C on substrate 14 (FIG. 6) with little or no relative horizontal motion of the contact line G and substrate 14 (the action of a rolling wheel) and with continuing rotation of shaft 56 around axis 18 displaces a second edge I of the curved stamping die 64 vertically away from substrate 14 as shown in FIG. 8 and then return to a top of stroke position as shown in FIG. 9.

One or more curved elements could be mounted along the horizontal length the crank arm to provide multiple areas across which multiple coincident contact lines G travel in a plane 88.

Figure 9:
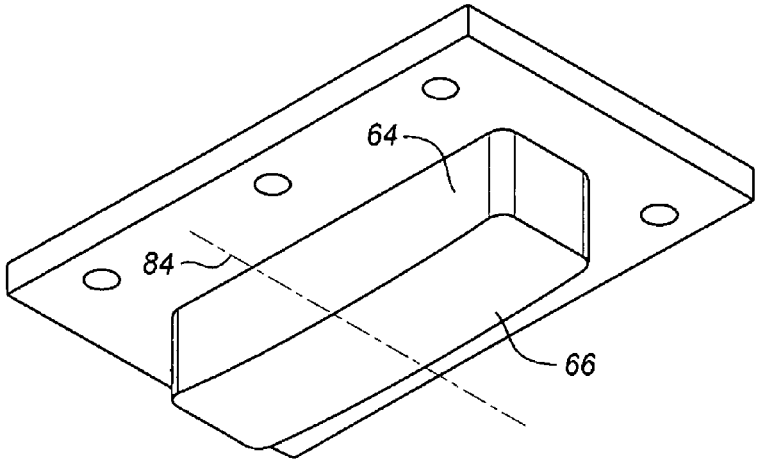
FIG. 9 is an isometric bottom view of a stamping die.
Figure 10:
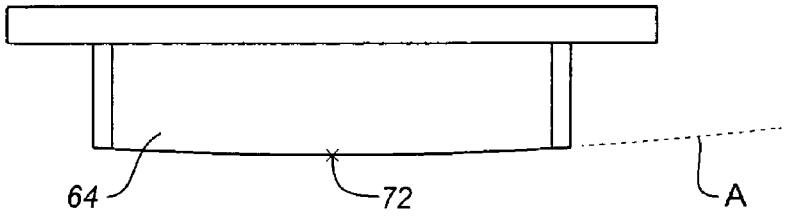
FIG. 10 is a side elevational view of the die shown in FIG. 9
Figure 11:
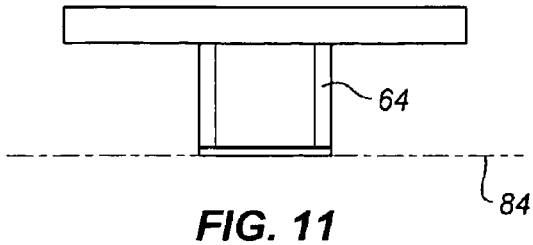
FIG. 11 is a front elevational view of the die shown in FIG. 9
Figure 12:
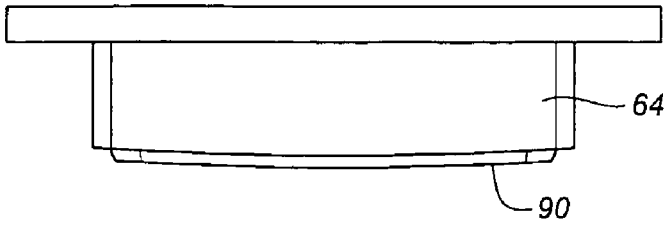
FIG. 12 is a side elevational view of a cutting die.
Figure 13:
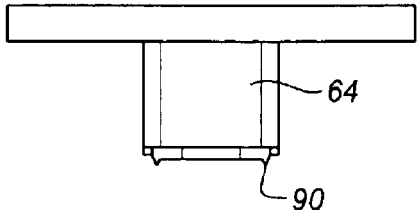
FIG. 13 is a front elevational view of the cutting die shown in FIG. 12
Figure 14:
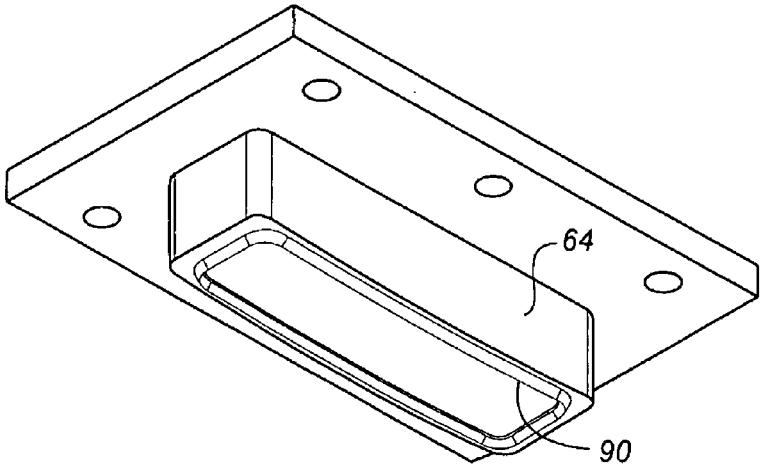
FIG. 14 is an isometric bottom view of the cutting die shown in FIG. 12

These curved elements, curved to the correct radius, could be cylindrical surfaces for hot stamping such as the die 64 Illustrated in FIGS. 9-11, or sharpened knives 90 for die cutting as illustrated in FIGS. 12-14, or other like curved tooling elements.

Either shaft 48 or shaft 56 may be split to reduce the crank shaft eccentric dimension B (axis 18 to axis 58) or the crank shaft can be manufactured as one piece.

If the size and load requirements of the stamping die are small, a single ended crank shaft may be used. If the size and load requirements are very large, three or more bearing supports for the crank shaft may be used.

Additional features may include a load and leveling adjustable resistance mechanism (not pictured) for anvil 44 to support the substrate to be hot stamped.

Additional features may also include rotating shaft 48 at a slow speed, required for good hot stamping at the bottom of the stroke while the curved surface is in contact with the material to be hot stamped and at a much faster speed during the rest of the stroke to thereby increase the overall hot stamping speed. Shaft 48 could also be rocked back and forth at the bottom of stroke to increase overall stamping speed.

The present invention described above references a preferred embodiment. Those skilled in the art will recognize that changes and modifications may be made to the described embodiments without departing from the nature and scope of the present invention. To the extent that such modifications and variations do not depart from the spirit of the Invention, they are intended to be included within the scope thereof and assessed only by the following claims.

What is claimed is:

1. An apparatus to provide a rolling motion of a curved die along a flat, stationary substrate supported on a flat anvil comprising, a rotating crankshaft with an axis of rotation and an eccentric axis of rotation, a crank-arm rotatably mounted at one end on a shaft with said eccentric axis and having at the other end (an extremity) at least one curved cylindrical die having a radius of curvature greater than the distance between an axis coincident with a line on the curved surface of said curved cylindrical die and said eccentric axis of rotation with said coincident axis parallel to said axis of rotation of said crankshaft and a mechanism to restrict said coincident axis to move in a plane parallel to a plane containing said crankshaft axis of rotation and perpendicular to said flat anvil when said curved die is in contact with said substrate.

2. The apparatus according to claim 1 with the crankshaft rotating at a slow speed at the bottom of the stroke while the curved surface is in contact with the substrate and at a much faster speed during the rest of the stroke.

3. The apparatus according to claim 1 with the crankshaft rocked back and forth at the bottom of stroke.

4. The apparatus according to claim 1 wherein the tool is a hot stamping die.

5. The apparatus according to claim 1 wherein the tool is a cutting die.

* * * * *